US010519808B2

(12) United States Patent
Hossbach et al.

(10) Patent No.: US 10,519,808 B2
(45) Date of Patent: Dec. 31, 2019

(54) TURBOCHARGER

(71) Applicant: MAN DIESEL & TURBO SE, Augsburg (DE)

(72) Inventors: Björn Hossbach, Diedorf (DE); Santiago Uhlenbrock, Gräfenberg (DE)

(73) Assignee: MAN Energy Solutions SE, Augsburg (DE)

( * ) Notice: Subject to any disclaimer, the term of this patent is extended or adjusted under 35 U.S.C. 154(b) by 96 days.

(21) Appl. No.: 15/970,578

(22) Filed: May 3, 2018

(65) Prior Publication Data

US 2018/0320554 A1 Nov. 8, 2018

(30) Foreign Application Priority Data

May 4, 2017 (DE) ..... 10 2017 207 540

(51) Int. Cl.
*F01D 25/24* (2006.01)

(52) U.S. Cl.
CPC ..... *F01D 25/246* (2013.01); *F01D 25/243* (2013.01); *F05D 2220/40* (2013.01); *F05D 2240/128* (2013.01); *F05D 2240/14* (2013.01)

(58) Field of Classification Search
CPC ... F01D 9/02; F01D 9/026; F01D 9/04; F01D 9/045; F01D 9/047; F01D 9/048; F01D 17/14; F01D 17/143; F01D 17/146; F01D 17/16; F01D 17/165; F01D 17/167; F01D 25/243; F01D 25/246; F05D 2220/40; F05D 2240/14; F05D 2240/128
See application file for complete search history.

(56) References Cited

U.S. PATENT DOCUMENTS

| | | | | |
|---|---|---|---|---|
| 4,586,878 | A * | 5/1986 | Witchger | F02C 6/12 415/166 |
| 2017/0234153 | A1* | 8/2017 | Williams | F01D 17/165 415/148 |
| 2017/0342997 | A1* | 11/2017 | Donaldson | F04D 27/0246 |
| 2018/0087531 | A1* | 3/2018 | Weisbrod | F01D 25/243 |
| 2018/0266273 | A1* | 9/2018 | Hossbach | F01D 5/043 |

* cited by examiner

*Primary Examiner* — Igor Kershteyn
(74) *Attorney, Agent, or Firm* — Cozen O'Connor

(57) ABSTRACT

A turbocharger, with a turbine for expanding a first medium and a compressor for compressing a second medium. The turbine has a turbine housing and a turbine rotor. The compressor has a compressor housing and a compressor rotor coupled to the turbine rotor via a shaft. The turbine and compressor housings are connected to a bearing housing in which the shaft is mounted. The turbine housing has a turbine inflow housing and an insert piece for a nozzle ring with guide blades, which is connected on a first cover ring with a flange of the bearing housing. On the flange of the bearing housing multiple protrusions extending radially to the outside distributed over the circumference and first fasteners penetrate the protrusions of the flange of the bearing housing and are in engagement with the first cover ring of the nozzle ring.

8 Claims, 3 Drawing Sheets

TURBOCHARGER

BACKGROUND OF THE INVENTION

1. Field of the Invention

The invention relates to a turbocharger.

2. Description of the Related Art

A turbocharger comprises a turbine and a compressor. In the turbine of a turbocharger, a first medium, in particular exhaust gas, is expanded and energy extracted in the process. In the compressor of the turbocharger, a second medium, in particular charge air, is compressed utilising the energy extracted in the turbine during the expansion of the first medium. The turbine of a turbocharger comprises a turbine housing and a turbine rotor. The compressor of the turbocharger comprises a compressor housing and a compressor rotor. The turbine rotor and compressor rotors are coupled via a shaft mounted in a bearing housing, wherein the bearing houses on the one hand is connected to the turbine housing and on the other hand to the compressor housing.

From practice it is likewise known that the turbine housing of a turbocharger comprises a turbine inflow housing via which the medium to be expanded can be fed to the turbine rotor. The turbine housing receives an insert piece and a nozzle ring. By way of the insert piece, expanded first medium can be discharged from the turbine, wherein the insert piece extends radially outside adjacent to moving blades of the turbine rotor. The nozzle ring, which is also described as turbine guide apparatus, guide grille, or guide apparatus comprises guide blades, which seen in the flow direction of the first medium, positioned upstream of the turbine rotor and via which the first medium to be expanded is conducted upstream of the turbine rotor.

With turbochargers known from practice, the turbine inflow housing is typically connected to the bearing housing via a clamping claw connection, wherein the nozzle ring is also fastened via the clamping claw connection, namely in that a flange of the nozzle ring is clamped between flanges or fastening sections of bearing housing and turbine inflow housing.

Accordingly, with turbochargers known from practice, nozzle ring and turbine inflow housing are mounted on the bearing housing jointly or dependent on one another.

During operation, the nozzle ring is subjected to thermally induced deformation. With turbochargers known from practice, this results in that the connection of the nozzle ring, the bearing housing, and the turbine inflow housing is likewise subjected to a deformation, as a result of which on the one hand a wear of this connection is brought about and on the other hand the sealing effect in the region of this connection is reduced. This is disadvantageous. There is therefore a need for more reliably fastening the nozzle ring on the bearing housing of the turbocharger.

SUMMARY OF THE INVENTION

One aspect of the present invention is a new type of turbocharger.

According to one aspect of the invention, the nozzle ring is connected on a first cover ring of the same to a flange of the bearing housing via first fasteners, wherein on the flange of the bearing housing, with which the first cover ring of the nozzle ring is connected, multiple protrusions radially extending to the outside and distributed over the circumference are formed, wherein the first fasteners penetrate the protrusions of the flange of the bearing housing and are in engagement with the first cover ring of the nozzle ring.

The connection of the nozzle ring with the flange of the bearing housing via the first fasteners, which act on the protrusions of the flange of the bearing housing, allows a reliable fastening of the nozzle ring on the bearing housing. Stresses, in particular tangential stresses, in the flange of the bearing housing are reduced namely in particular in that the protrusions of the flange of the bearing housing can deform due to temperature more rapidly and thus more evenly together with the nozzle ring.

Preferentially, the first fasteners extend in axial direction, starting out from the bearing housing seen in the direction of the turbine housing, through the protrusions of the flange of the bearing housing into the first cover ring of the nozzle ring. This allows a particularly advantageous assembly of the nozzle ring on the bearing housing.

According to a further development of the invention, the nozzle ring is connected on a second cover ring of the same with a flange of the insert piece via second fasteners, wherein the second fasteners penetrate the flange of the insert piece and are in engagement with the second cover ring of the nozzle ring preferentially in such a manner that the second fasteners extend in the axial direction starting out from the turbine housing seen in the direction of the bearing housing through the flange of the insert piece into the second cover ring of the nozzle ring. These characteristics allow a particularly advantageous assembly of the insert piece on the nozzle ring.

According to a further development of the invention, the turbine inflow housing is fastened to the bearing housing independently of the nozzle ring via separate fasteners. This is preferred in order to ensure a good sealing effect of the connection between turbine inflow housing and bearing housing and thereby avoid an undesirable leakage of the first medium expanding in the turbine into the surroundings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

The invention relates to a turbocharger. A turbocharger comprises a turbine for expanding a first medium, in particular for expanding exhaust gas of an internal combustion engine. Furthermore, a turbocharger comprises a compressor for compressing a second medium, in particular of charge air, namely utilising energy extracted in the turbine during the expansion of the first medium. The turbine comprises a turbine housing and a turbine rotor. The compressor comprises a compressor housing and a compressor rotor. The compressor rotor is coupled to the turbine rotor via a shaft mounted in a bearing housing, wherein the bearing housing is positioned between the turbine housing and the compressor housing and is connected both to the turbine housing and the compressor housing. The person skilled in the art addressed here is familiar with this fundamental construction of a turbocharger.

Figure 1:
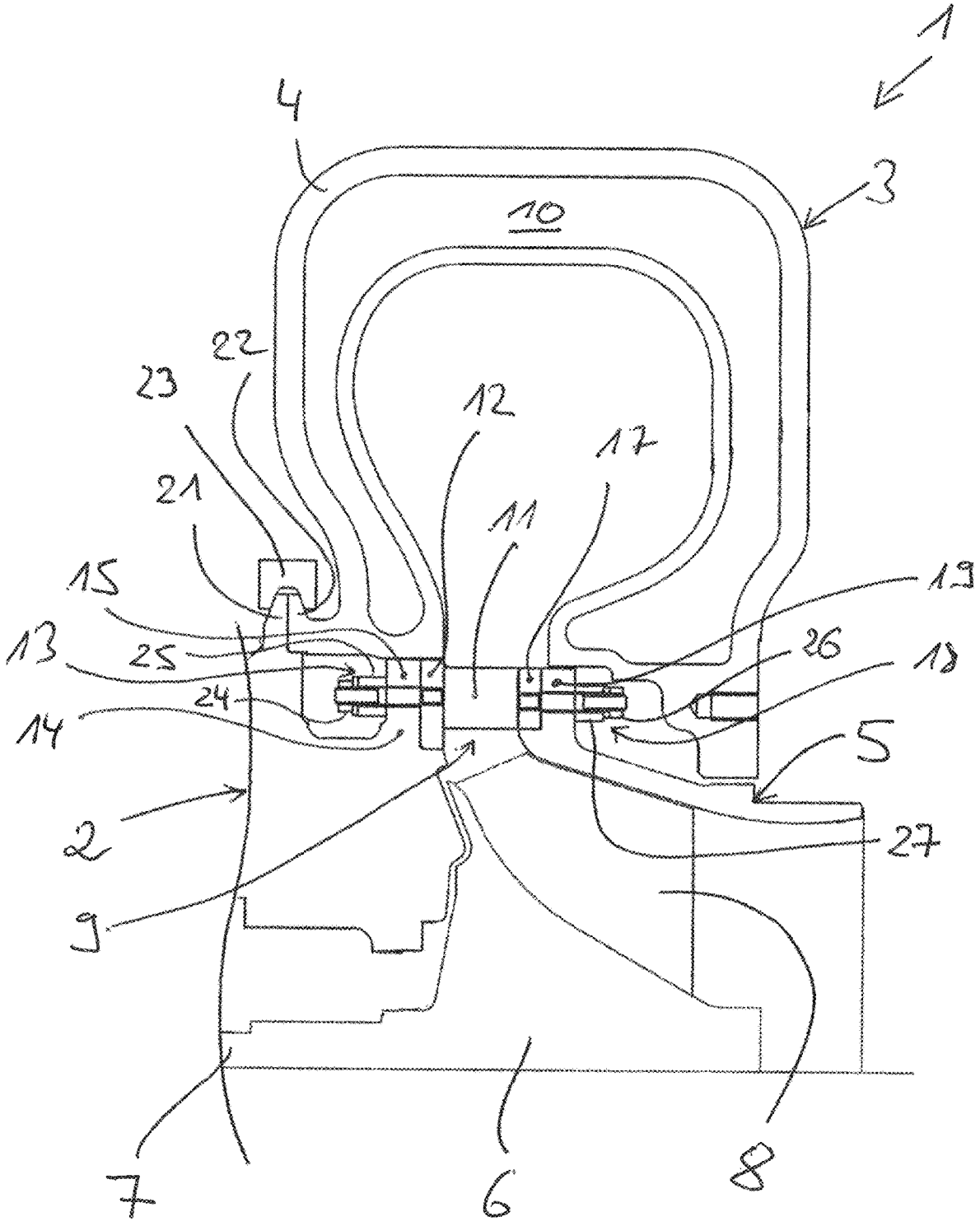
FIG. 1: is a cross section in axial direction through a turbocharger in a region a turbine and of a bearing housing.
Figure 2:
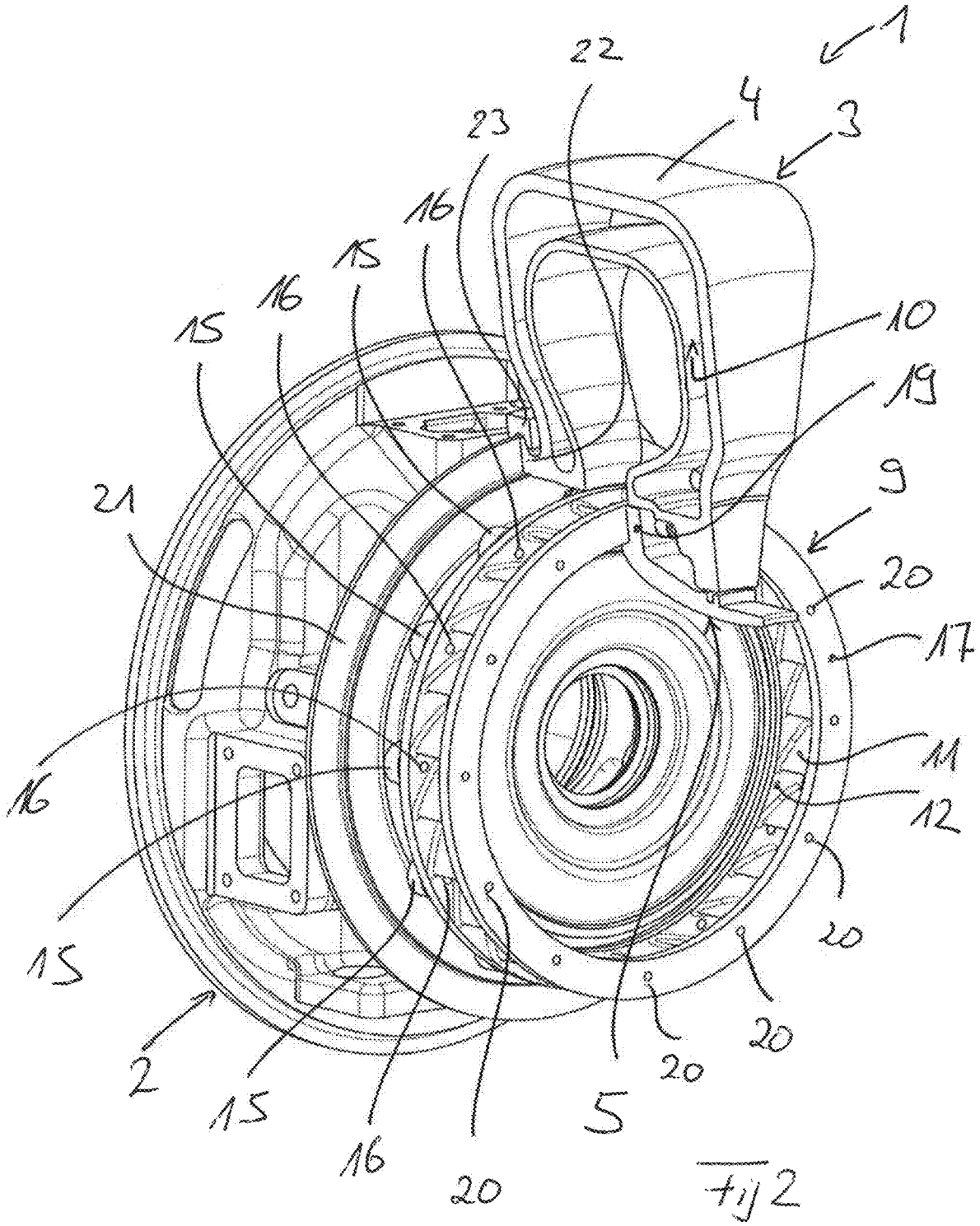
FIG. 2: is a perspective view of the arrangement of FIG. 1 with an insert piece that is partially shown and a turbine inflow housing that is partially shown.
Figure 3:
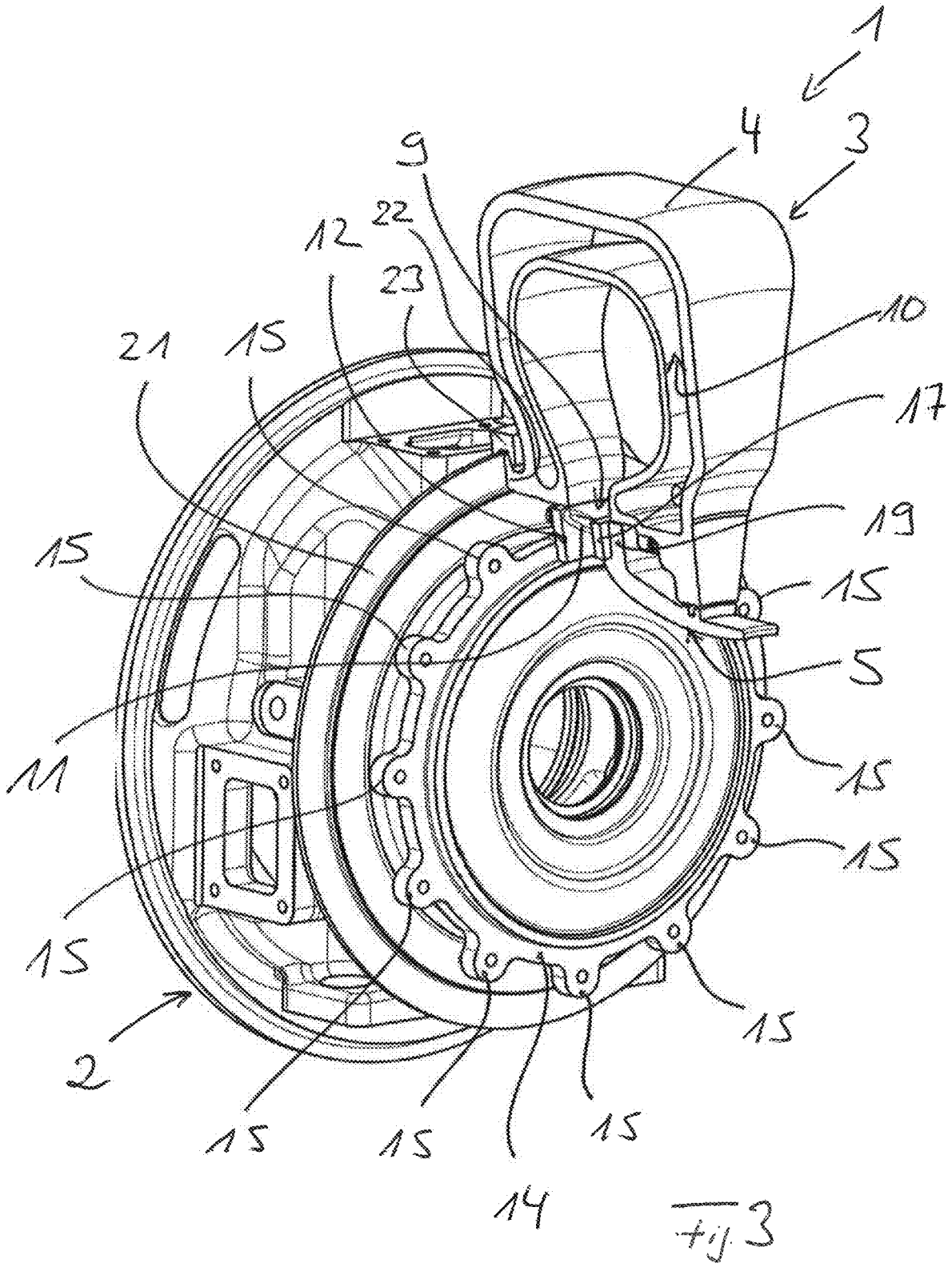
FIG. 3: is the arrangement of FIG. 2 with a partially shown nozzle ring.

FIGS. 1 to 3 show different views of an extract of a turbocharger in the region of a turbine 1 and of a bearing housing 2. The turbine 1 comprises a turbine housing 3 and a turbine rotor 6. A compressor of the turbocharger which is not shown comprises a compressor housing and a compressor rotor, wherein the turbine rotor 6 is coupled to the compressor rotor which is not shown via a shaft 7, which is rotatably mounted in the bearing housing 2. The turbine 1 of the turbocharger is embodied as a radial turbine. In terms of this invention, radial turbines is to mean also so-called mixed flow turbines, in which the gas inflow takes place in the radial direction not only exactly perpendicularly to the shaft 7, but at an angle to the shaft 7.

The turbine housing 3 comprises a turbine inflow housing 4, which in the shown exemplary embodiment is embodied double-walled and forms a cooling duct 10 for cooling the turbine inflow housing 4. By way of the turbine inflow housing 4, the first medium to be expanded, preferentially hot exhaust gas, can be fed to the turbine rotor 6.

The turbine housing 3 accommodates an insert piece 5 and a nozzle ring 9. The nozzle ring 9 comprises guide blades 11 that conduct the flow of the first medium to be expanded upstream of the turbine rotor 6. The turbine rotor 6 is bladed with moving blades 8, which seen in the flow direction of the exhaust gas, are positioned downstream of the guide blades 11 of the nozzle ring 9. Downstream of the nozzle ring 9, the insert piece 5 adjoining the moving blades 8 of the turbine rotor 6 radially on the outside defines the flow duct for the first medium, wherein the first medium to be expanded in the turbine 1 can be discharged from the turbine 1 via the insert piece 5.

In the turbocharger according to the invention, the nozzle ring 9 is connected on a first cover ring 12 of the same to a flange 14 of the bearing housing 2 via first fasteners 13, wherein on the flange 14 of the bearing housing 2, with which the first cover ring 12 of the nozzle ring 9 is connected, multiple protrusions 15 extending radially to the outside distributed over the circumference of said nozzle ring 9 are formed.

These protrusions 15 can also be described as lugs or rosettes. The first fasteners 13 penetrate these lug-like or rosette-like protrusions 15 of the flange 14 of the bearing housing 2 and act on the first cover ring 12 of the nozzle ring 9.

According to FIG. 1, the first fasteners 13 seen in the axial direction extend, starting out from the bearing housing 2 in the direction of the turbine housing 3 through the protrusions 15 of the flange 14 of the bearing housing 2 into the first cover ring 12 of the nozzle ring 11. The first fasteners 13 are preferentially embodied as threaded pins which, in those sections that extend into the first cover ring 12 of the nozzle ring 9, have an external thread wherein these external threads are then in engagement with corresponding internal threads in threaded bores 16 of the first cover ring 12 of the nozzle ring 9. On opposite sections of these threaded pins, which project in the axial direction relative to the flange 14 or the protrusions 15 formed on the flange 14 of the bearing housing 2, an external thread is likewise formed, which interacts with corresponding nuts 24 in order to thereby assemble the nozzle ring 9 securely and easily on the bearing housing 2. The nuts 24 support themselves via sleeves 25 on the flange 14 of the bearing housing 2. The sections of the threaded pins, which extend through the lug-like or rosette-like protrusions 15 of the flange 14 of the bearing housing 2 and between which the sections of the threaded pins carrying the external threads are arranged, are preferentially threadless.

On a second cover ring 17 located opposite the first cover ring 12, the nozzle ring 9 is connected to a flange 19 of the insert piece via second fastening means 18, wherein the second fasteners 18 penetrate the flange 19 of the insert piece 15 and are in engagement with the second cover ring 17 of the nozzle ring 9. The second fasteners 19, which in turn are preferentially threaded pins, extend seen in the axial direction starting out from the turbine housing 3 in the direction of the bearing housing 2 through the flange 19 of the insert piece 5 into the second cover ring 17 of the nozzle ring 9.

Thus, while the first fasteners 13, which serve for fastening the nozzle ring 9 to the bearing housing 2, extend seen in the axial direction starting out from the bearing housing 2 in the direction of the turbine housing into the first cover ring 12 of the nozzle ring 9, the second fasteners 18 extend turned by approximately 180° in the opposite axial direction starting out from the insert piece 5 or starting out from the turbine housing 3 in the direction of the bearing housing 2 into the second cover ring 17 of the nozzle ring 9.

As already explained, the second fasteners 18 in turn are preferentially threaded pins that carry external threads on opposite sections, namely on first sections a first external thread, which engage in corresponding threaded bores 20 of the second cover ring 17 of the nozzle ring 9, and further external threads on second sections located opposite, which interact with a nut 26 in order to thereby fasten the insert piece 5 to the nozzle ring 9. These nuts 26 support themselves via sleeves 27 on the flange 19 of the insert piece 5. Between these sections of the threaded pins carrying the external thread the same are formed preferentially threadless on sections that extend through the flange 19 of the insert piece 5.

The turbine inflow housing 4 of the turbine housing 3 is fastened to the bearing housing 2 independently of the nozzle ring 9 and independently of the insert piece 5, in the shown exemplary embodiment of FIGS. 1 to 3 in such a manner that a clamping ring 23 acts on adjoining flanges 21, 22 of bearing housing 2 and turbine inflow housing 4.

In contrast with such a clamping ring 23, the flanges 21, 22 of bearing housing 2 and turbine inflow housing 4 adjoining one another can also be connected to one another via a clamping claw connection and/or screw connections.

Accordingly, in the case of the turbocharger according to one aspect of the invention, fastening the nozzle ring 9 to the bearing housing 2 is effected via first fasteners 13, which on the one hand interact with the flange 14 of the bearing housing 2 and on the other hand with the first cover ring 12 of the nozzle ring 9 namely penetrate the radial protrusions 15 of the flange 14, which can also be described as lugs or rosettes, in the region of the flange 14 of the bearing housing 2. These protrusions 15 can expand together with the nozzle ring 9 as a result of which stresses in the connection between bearing housing 2 and nozzle ring 9 are minimised. The insert piece 5 is fastened to the nozzle ring 9 via second fasteners 18. The turbine inflow housing 4 is mounted to the bearing housing 2 independently of this. For the assembly, the insert piece 5 is initially assembled on the nozzle ring 9 via the second fasteners 18 wherein subsequently the pre-assembled unit of insert piece 5 and nozzle ring 9 are fastened to the bearing housing 2 via the first fasteners 13. Following this, the turbine inflow housing 4 can be assembled on the bearing housing 2.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A turbocharger, comprising:

a shaft;

a turbine configured to expand a first medium that comprises:

a turbine housing that comprises:

a turbine inflow housing;

a nozzle ring with guide blades; and an insert piece that accommodates the nozzle ring; and a turbine rotor;

a compressor configured to compress a second medium utilizing energy extracted in the turbine during expansion of the first medium that comprises:

a compressor housing; and a compressor rotor coupled to the turbine rotor via the shaft; and a bearing housing arranged between and connected to the turbine housing and the compressor housing and in which the shaft is mounted;

wherein the nozzle ring on a first cover ring is connected to a flange of the bearing housing via first fasteners, wherein the flange of the bearing housing comprises multiple protrusions extending radially to the outside distributed over a circumference of the flange, wherein respective first fasteners penetrate each protrusion of the flange of the bearing housing and are in engagement with the first cover ring of the nozzle ring.

2. The turbocharger according to claim 1, wherein the first fasteners extend in axial direction starting from the bearing housing, seen in direction of the turbine housing, through the protrusions of the flange of the bearing housing, and into the first cover ring of the nozzle ring.

3. The turbocharger according to claim 2, wherein the nozzle ring is connected on a second cover ring of the nozzle ring to a flange of the insert piece via second fasteners, and wherein the second fasteners penetrate the flange of the insert piece and are in engagement with the second cover ring of the nozzle ring.

4. The turbocharger according to claim 3, wherein the second fasteners, starting out in the axial direction from the turbine housing extend, seen in the direction of the bearing housing, through the flange of the insert piece and into the second cover ring of the nozzle ring.

5. The turbocharger according claim 4, wherein the turbine inflow housing is fastened to the bearing housing independently of the nozzle ring via a separate fastener.

6. The turbocharger according to claim 1, wherein the turbine is a radial turbine.

7. The turbocharger according to claim 1, wherein the nozzle ring is connected on a second cover ring of the nozzle ring to a flange of the insert piece via second fasteners, and wherein the second fasteners penetrate the flange of the insert piece and are in engagement with the second cover ring of the nozzle ring.

8. The turbocharger according to claim 1, wherein the turbine inflow housing is fastened to the bearing housing independently of the nozzle ring via a separate fastener.

* * * * *